US009988818B1

(12) United States Patent
Tanghongs

(10) Patent No.: US 9,988,818 B1
(45) Date of Patent: Jun. 5, 2018

(54) ROOFTOP RAINWATER DRAINAGE ASSEMBLY

(71) Applicant: James Tanghongs, Richardson, TX (US)

(72) Inventor: James Tanghongs, Richardson, TX (US)

( * ) Notice: Subject to any disclaimer, the term of this patent is extended or adjusted under 35 U.S.C. 154(b) by 0 days. days.

(21) Appl. No.: 15/463,783

(22) Filed: Mar. 20, 2017

(51) Int. Cl.

| | |
|---|---|
| ***E04D 13/08*** | (2006.01) |
| ***E04D 13/064*** | (2006.01) |
| ***E04D 13/04*** | (2006.01) |
| ***E04B 1/70*** | (2006.01) |

(52) U.S. Cl.
CPC ..... *E04D 13/08* (2013.01); *E04B 1/7038* (2013.01); *E04D 13/0409* (2013.01); *E04D 13/0477* (2013.01); *E04D 13/064* (2013.01); *E04D 13/0643* (2013.01); *E04D 2013/0413* (2013.01); *E04D 2013/0813* (2013.01); *E04D 2013/0826* (2013.01); *E04D 2013/0893* (2013.01)

(58) Field of Classification Search
CPC . E04D 13/08; E04D 13/0477; E04D 13/0409; E04D 13/064; E04D 13/0643; E04D 2013/0826; E04D 2013/0413; E04D 2013/0813; E04D 2013/0893; E04B 1/7038
See application file for complete search history.

(56) References Cited

U.S. PATENT DOCUMENTS

| | | | | | |
|---|---|---|---|---|---|
| 739,559 | A * | 9/1903 | Rinker | E04D 13/064 | 5/284 |
| 1,046,910 | A * | 12/1912 | Wagner | E04D 13/064 | 52/11 |
| 1,301,934 | A * | 4/1919 | Guion | E04D 13/064 | 52/14 |
| 1,322,189 | A * | 11/1919 | Holt | E04D 13/064 | 285/368 |
| 277,740 | A | 1/1957 | Ager | | |
| 6,357,964 | B1 * | 3/2002 | DeGarie | B09B 1/004 | 220/216 |
| 8,707,649 | B2 * | 4/2014 | Wilkie | E04F 13/0835 | 52/533 |
| 2008/0127576 | A1 | 6/2008 | Porat | | |
| 2011/0232766 | A1 * | 9/2011 | Bell | E04D 13/08 | 137/1 |

FOREIGN PATENT DOCUMENTS

| | | | | |
|---|---|---|---|---|
| CN | 201588348 U | | 9/2010 | |
| DE | 3218190 | A1 * | 11/1983 | E04B 1/945 |
| DE | 19628732 | A1 * | 3/1998 | E04D 13/08 |
| WO | WO-2004033814 | A1 * | 4/2004 | E04B 7/12 |
| WO | WO-2007080380 | A1 * | 7/2007 | E04D 13/064 |
| WO | WO-2015120175 | A1 * | 8/2015 | E04D 13/08 |

* cited by examiner

*Primary Examiner* — Jeanette E Chapman
(74) *Attorney, Agent, or Firm* — Law Office of Sam Sokhansanj PLLC

(57) ABSTRACT

A rooftop rainwater drainage assembly that is at least partially concealed from view from an exterior of a dwelling. In particular, the rooftop drainage assembly can include an opening spout secured to a roof deck region of a dwelling, and an elongated downspout having a first region disposed between an exterior wall and an interior wall of the dwelling and secured to the opening spout, thereby at least partially concealing the downspout from view from both the interior wall and exterior wall of the dwelling.

13 Claims, 6 Drawing Sheets

ROOFTOP RAINWATER DRAINAGE ASSEMBLY

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Gutters and downspouts are mounted on most residential and commercial structures along the lower edge of the roof of the structure to receive water draining off of a roof, such as during a rainstorm. In addition, gutters come in many different styles, including K gutter, half round gutter, or commercial box gutter, but all are generally formed with an open top through which water is received into a trough or channel that delivers the water by gravity to a downspout for discharge away from the building structure.

A common complaint made usually by home owners or building developers of conventional gutters is, among other things, their lack or ornamental qualities. They do not add to the attractiveness of a home or other building and, if anything, they detract from its beauty. For example, often the conventional gutters appear rotted, sagging with overflowing matter, or weather beaten and discolored. As such it is not a pleasant sight and, were it not for the fact that rain water must be carried from the roof, this type of gutter would be quickly removed or not installed in new development residential homes or commercial buildings.

Therefore, what is needed is rainwater diversion and drainage system to replace conventional gutters that can be hidden from view, while effectively diverting water away from the roof of a building but does not take away from the building's attractiveness, beauty, or architectural design.

BRIEF SUMMARY

In one aspect of the present disclosure described herein, A rooftop rainwater drainage assembly that is at least partially concealed from view from an exterior of a dwelling. In particular, the rooftop drainage assembly can include an opening spout secured to a roof deck region of a dwelling, and an elongated downspout having a first region disposed between an exterior wall and an interior wall of the dwelling and secured to the opening spout, thereby at least partially concealing the downspout from view from both the interior wall and exterior wall of the dwelling.

In another aspect of the disclosure described herein, a rooftop rainwater drainage assembly is disclosed having a first spout secured to a roof deck region of a dwelling, and a first elongated pipe spout having a first region disposed between an exterior wall and an interior wall of the dwelling and secured to the first spout. In addition, the drainage assembly can include wherein the first elongated pipe includes a second region that extends out of the exterior wall of the dwelling. In addition, a second spout can be secured to a roof deck region of a dwelling. Further, a second elongated pipe spout having a third region can be disposed between the exterior wall and an interior wall of the dwelling and secured to the second spout, and the second elongated pipe having a fourth region that extends out of the exterior wall of the dwelling. The drainage assembly may also include wherein the second spout comprises a region that is above the first spout. In addition, a third spout or opening may be disposed within a parapet wall region of the dwelling. Further, the third spout may further include one or more gates, latches, or doors. In addition, the first spout can further include a perforated drain cover. Further, a flexible membrane cover can be secured to the first spout and first pipe. In addition, the drainage assembly can include a bracket supporting the flexible membrane cover. Here, the flexible membrane cover can be further secured to the roof deck region of the dwelling. In addition, the flexible membrane cover can be further secured to a metal standing seam roof of the dwelling. Further, the first region of the first pipe can be disposed between a pair of studs of the dwelling. Also, a lower end area of the first spout is disposed within an attic space area of the dwelling.

In another aspect of the disclosure described herein, a rooftop rainwater drainage system is disclosed. Here, the drainage assembly can include a first drain spout secured to a roof region of a dwelling and disposed adjacent to a corner of the roof region, and a first drain pipe secured to the first drain spout, wherein the first drain pipe comprises a first region disposed between an exterior wall and an interior wall of the dwelling, thereby concealing the first region of the first drain pipe from both the interior wall and exterior wall. The drainage assembly can further include a second drain spout and a second drain pipe, wherein the second drain spout is secured to the second drain pipe and configured to divert rainwater away from the exterior wall of the dwelling. In addition, the drainage assembly can include a third drain spout secured to the roof region of the dwelling and disposed adjacent to a corner of the roof region.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
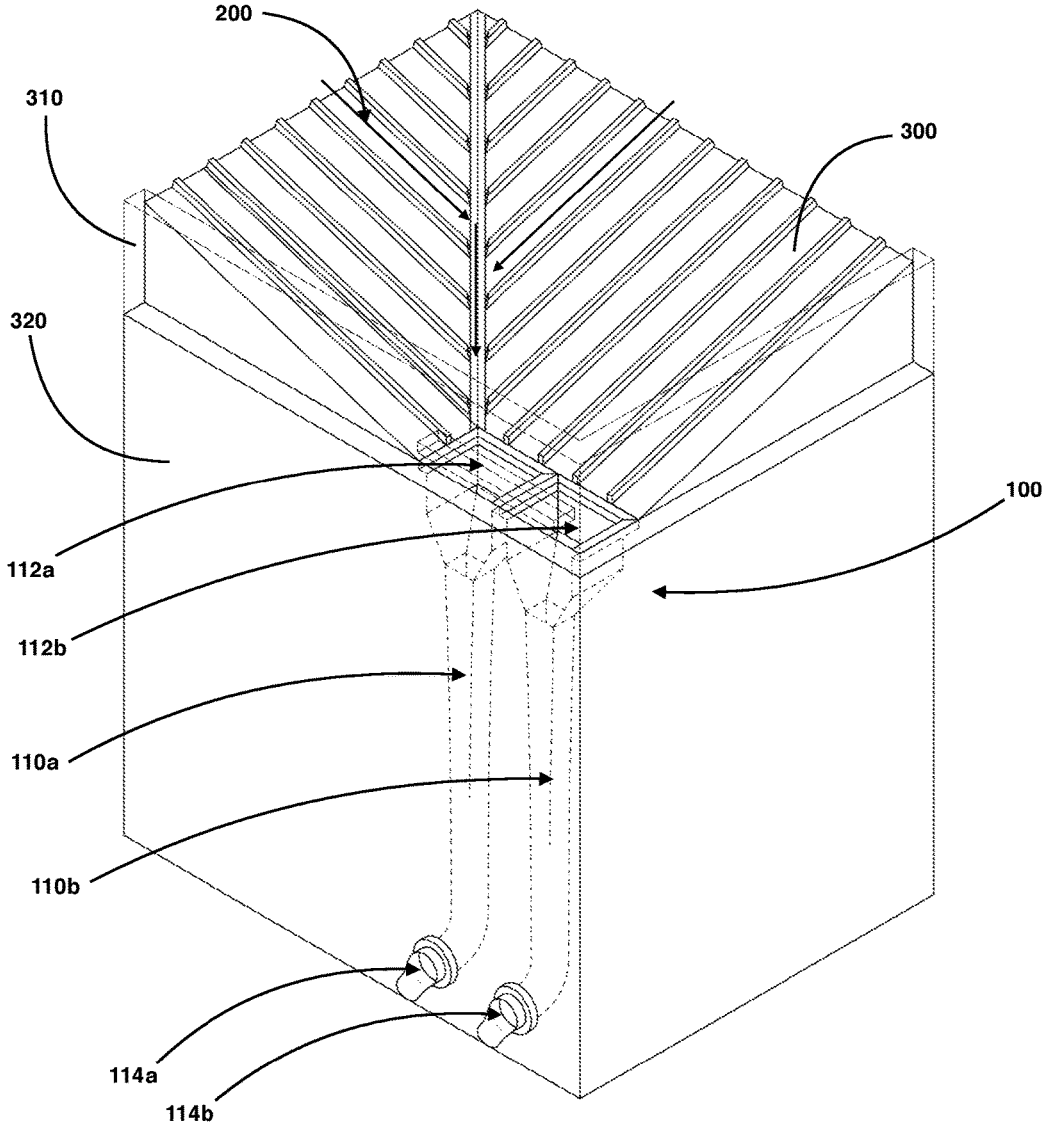
FIG. 1 illustrates a perspective view for one non-limiting embodiment of the rooftop rainwater drainage assembly of the disclosure described herein.
Figure 2:
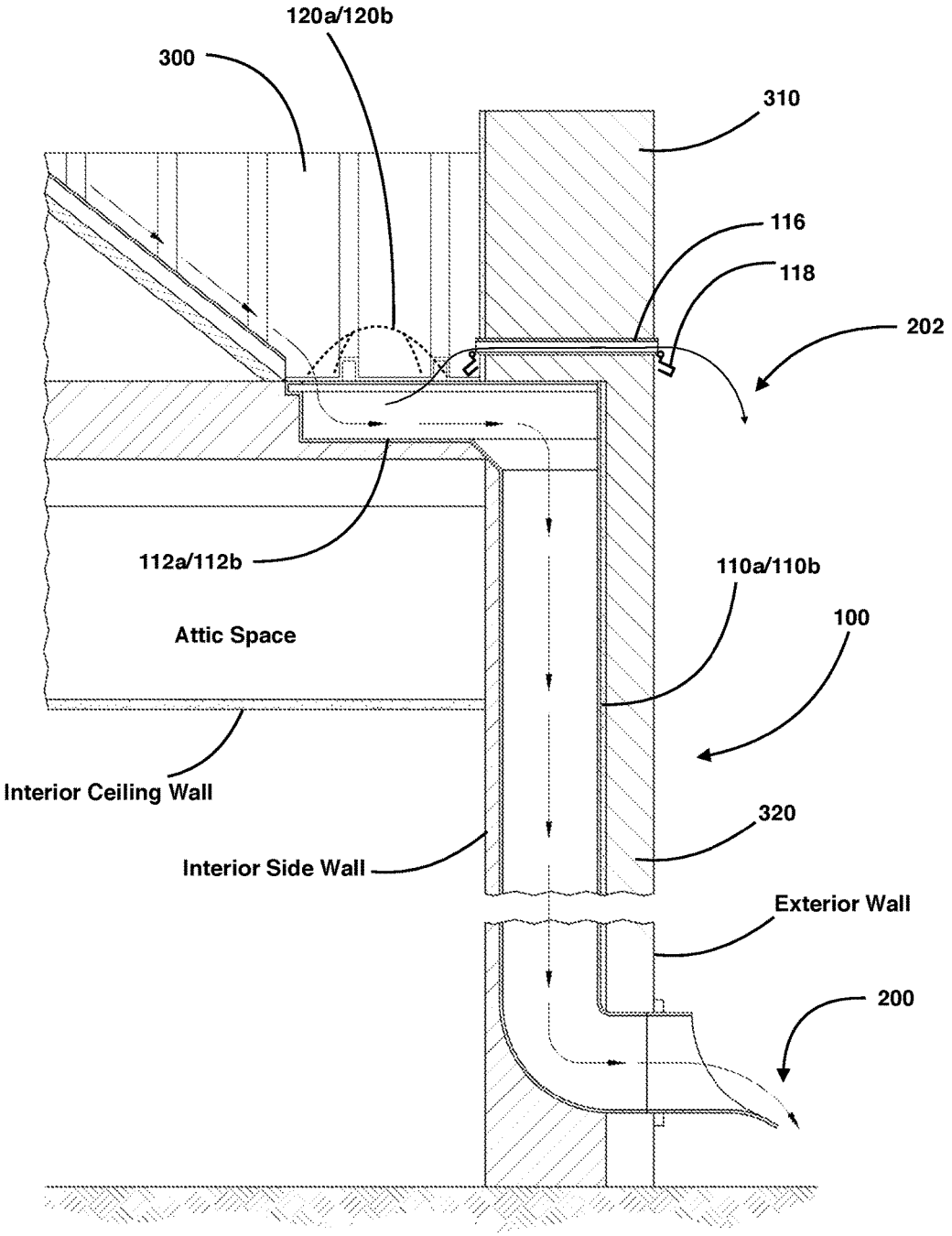
FIG. 2 illustrates a partial cross-sectional view for the rooftop rainwater drainage assembly of the disclosure described herein.

FIG. 1 illustrates one non-limiting embodiment of the rooftop rainwater drainage and diverting system, assembly, apparatus, and method of construction of the disclosure described herein. Here, the rooftop drainage assembly 100 is generally shown having a pair of open spouts 112*a* and 112*b* affixed to a roof region of a dwelling. In particular, the dwelling can include a standing seam metal roof 300 configured at a pitch such that rainwater 200 flows between the seams and down a valley towards spouts 112*a* and 112*b*. Alternatively, any other roofing material may also be used, such as thermoplastic polyolefin (TPO), among others. In addition, the dwelling may include parapet walls 310 to conceal the rooftop and/or spouts from view, and further include one or more overflow spouts 116, as shown in FIG. 2. Still referring to FIG. 1, rooftop drainage assembly 100 is further shown with spouts 112*a* and 112*b* secured to a pair of tubes, downspouts, or piping 110*a* and 110*b* for directing the rainwater from spouts 112*a* and 112*b* out of outlets or spouts 114*a* and 114*b* and away from the dwelling. Here, pipings 110*a* and 110*b* are configured such that they are disposed within walls 320, thereby concealing them from view from either the exterior of the dwelling or from the interior. In other words, drainage assembly 100, and more specifically pipings 110*a* and 110*b* are configured such that they are between the exterior siding of the building and the interior sheet rock (or drywall) of the dwelling, thereby concealed from view.

Figure 2A:
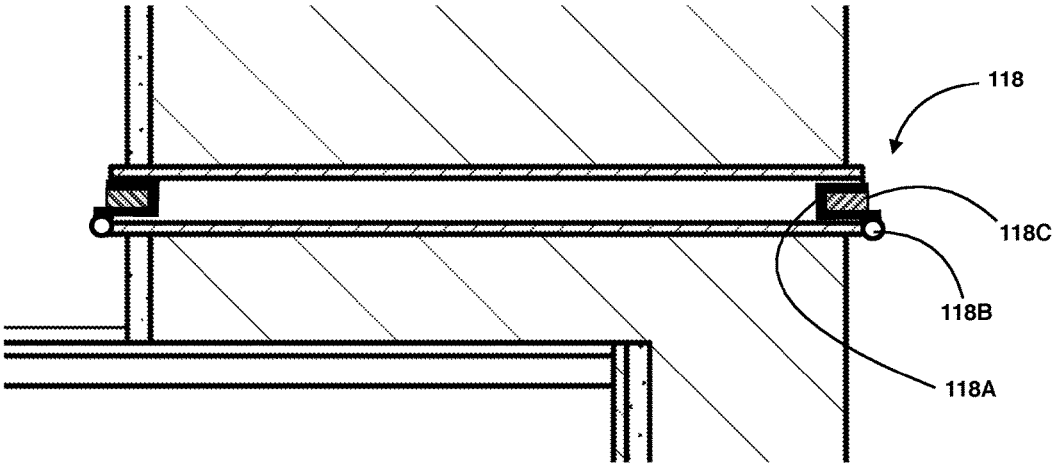
FIG. 2A-2B illustrate partial cross-sectional close-up side views of an overflow gate assembly of the disclosure described herein.
Figure 2B:
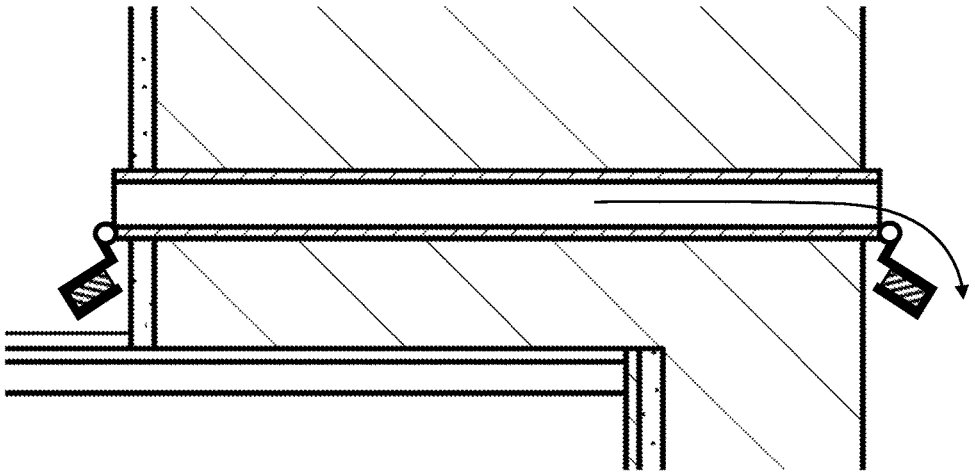

FIG. 2 illustrates a partial cross-sectional view of the rooftop drainage assembly. In particular, spouts 112*a* and 112*b* can be configured such that they are at least partially disposed or embedded within the roof area of the dwelling. In addition, parapet wall 310 of the dwelling may include one or more overflow openings or spouts 116 embedded within parapet wall 310. Overflow spouts 116 can further include latches or gates 118 that can automatically pivot open due to water pressure or rising water levels. For example, gates 118 may be spring biased or remotely controlled, powered, or trigger actuated. Specifically, as shown in FIGS. 2A-2B, gates 118 can include a U-shaped bracket 118A that pivots about an axis or hinge 118B. Further bracket 118A may have an insert 118C disposed and secured within the bracket, wherein insert 118C may resemble, match, or include material that is part of the siding of the dwelling, thereby concealing gate 118 from view from the exterior of the dwelling. In addition, as shown in FIG. 2B, in the open position, bracket 118A may abut against the exterior wall or siding of the dwelling and operate as a drip-edge to allow overflow rain water to flow over and not run down the exterior of the dwelling. In other words, the configuration gate 118 prevents the overflow rain water from the roof from making contact with or flowing directly down the side of the dwelling. Here, overflow spouts 310 are adapted to receive overflowing rainwater 202 that may excessively accumulate in the instance that either one or both of spouts 112*a* and 112*b* become clogged or partially clogged with debris from the rooftop. In addition, since rainwater 202 may flow out of spouts 116 towards the exterior of the dwelling, it can provide a visual cue for a user, home owner, or building operator that one or more components of the drainage assembly have become clogged or are not draining properly, thereby requiring maintenance, repair, or clean-up.

Figure 3:
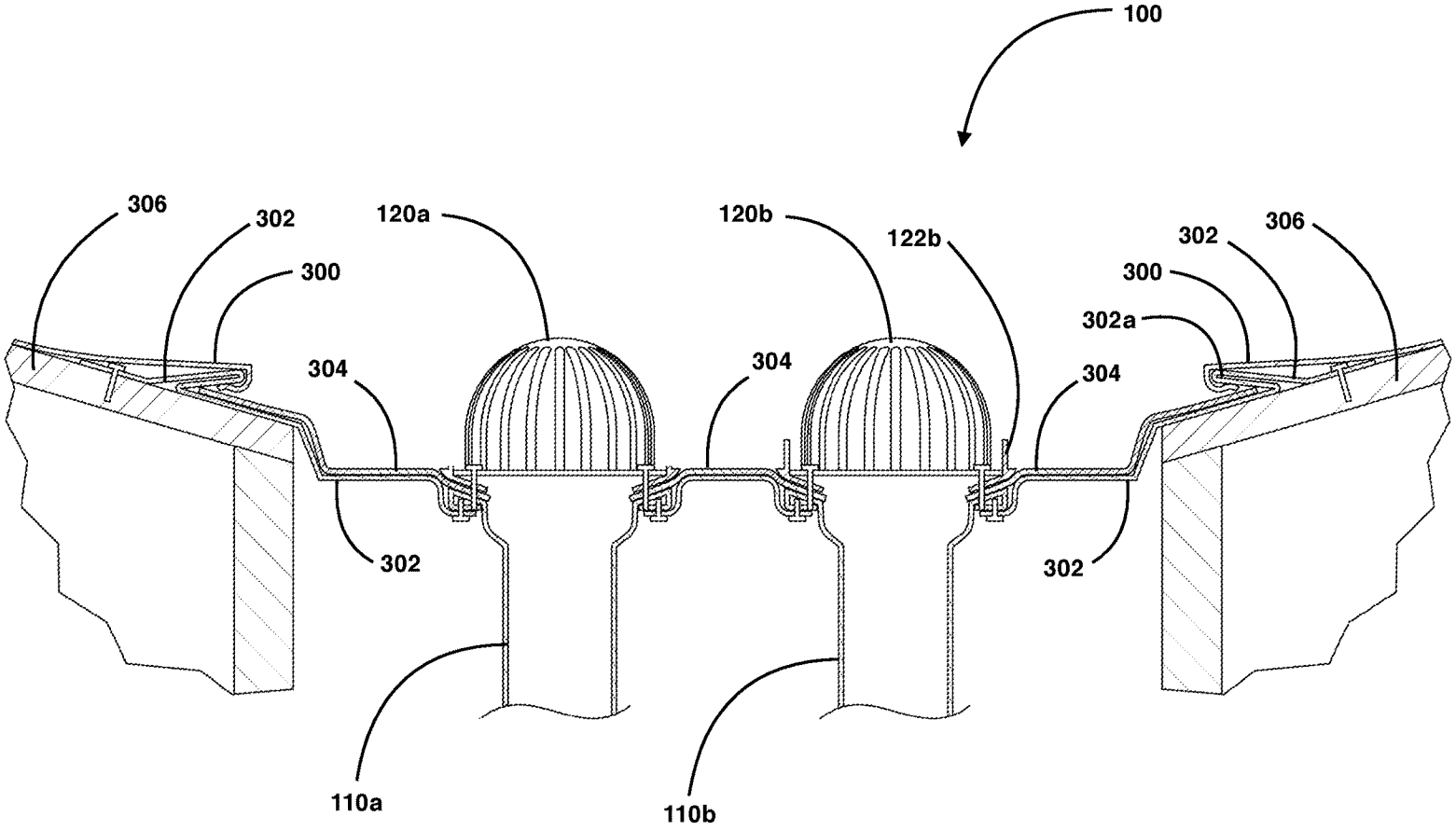
FIG. 3 illustrates another partial cross-sectional view for the rooftop rainwater drainage assembly of the disclosure described herein.

FIG. 3 illustrates another partial cross sectional view of the rooftop rainwater drainage assembly of the disclosure described herein. Here, rooftop drainage assembly 100 is further shown with a pair of drain or spout covers 120*a* and 120*b* to help prevent debris from entering the spouts and/or piping 110*a* and 110*b*, while having opening to allow rainwater to flow there through. Here, rooftop rainwater drainage assembly 100 is further shown with a waterproof or water-resistant flexible membrane material cover 304 secured to the covers 120*a*/120*b*, piping 110*a*/110*b*, and metal roof 300. In particular, membrane cover 304 is generally adapted to allow rain water to run off the roof and to spouts 120*a* and 120*b*, while preventing water from leaking through any portion of the roof or interior walls of the dwelling. In addition, a metal formed panel or brackets 302 can be secured to roof deck 306, wherein brackets 302 are configured to support membrane cover 304 and to further securely couple to spouts 120*a*/120*b*, piping 110*a*/110*b*, and metal roof seam 306, via a plurality of fasteners and crimping. In addition, 302 includes an open hem region to allow other materials to be disposed therein or around, such as additional waterproof sealants 304. Still referring to FIG. 3, it is contemplated within the scope of the disclosure described herein that spouts 112*a* and 112*b* may either work in unison, or one spout may provide backup or overflow protection in the instance that one of the other spouts is clogged. For example, one of the spouts that is providing overflow protection, such as spout 120*b*, may be elevated slightly above the other spout or have a cylindrical raised barrier 122*b*, thereby only draining rainwater when the rainwater has elevated above the top of the barrier 122*b*.

Figure 4:
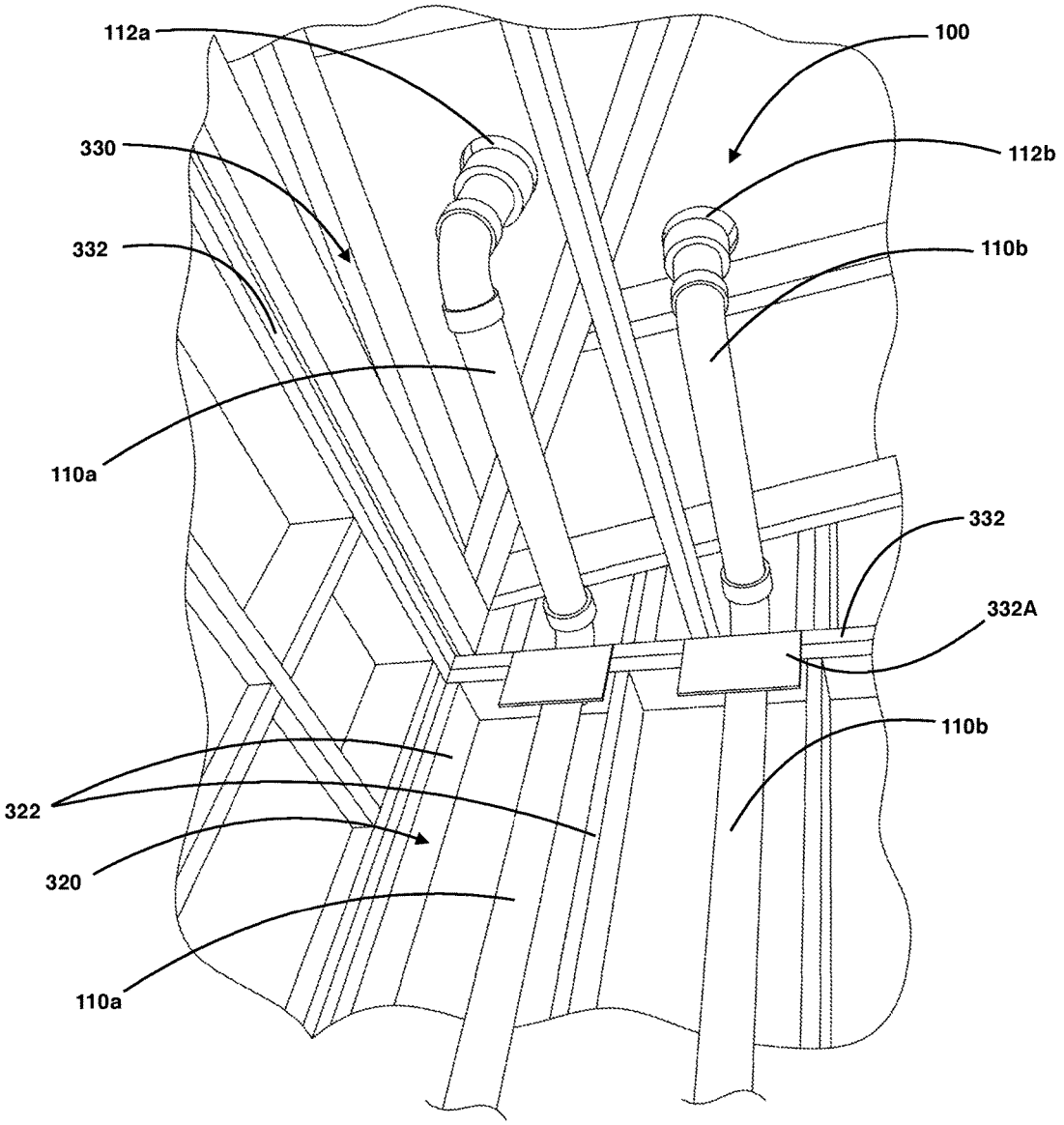
FIG. 4 illustrates a perspective partial interior view of the rooftop rainwater drainage assembly of the disclosure described herein.

FIG. 4 illustrates an interior view of the dwelling, shown here without drywall or sheet rock covering and concealing drainage assembly 100 and more specifically piping 110*a* and 110*b*. Here, rooftop rainwater drainage assembly 100 is shown with piping 110*a* having an overhead top region disposed generally in the attic area 300 of the dwelling (above the interior ceiling), which can then merge towards the outer walls of the dwelling and below ceiling line 332 and then down within walls 320 of the dwelling. For example, piping 110*a* is shown here disposed between a pair of wall studs 322. In addition, a pair of metal plates 332A can be secured to the framing to prevent nails or other fasteners from penetrating through piping 110*a* and 110*b* during the installation of drywall or other material in or around piping 110*a* and 110*b*. Here piping 110*a* and 110*b* can take any form and use any type of tubing or fittings depending on the design of the dwelling, such as elbow fittings, Y-joints, T-joints, and the like. In addition, the rooftop drainage assembly may be constructed from any material, such as metal, PVC, thermoplastic polyolefin (TPO), wood, cement, or any other suitable material.

Figure 5:
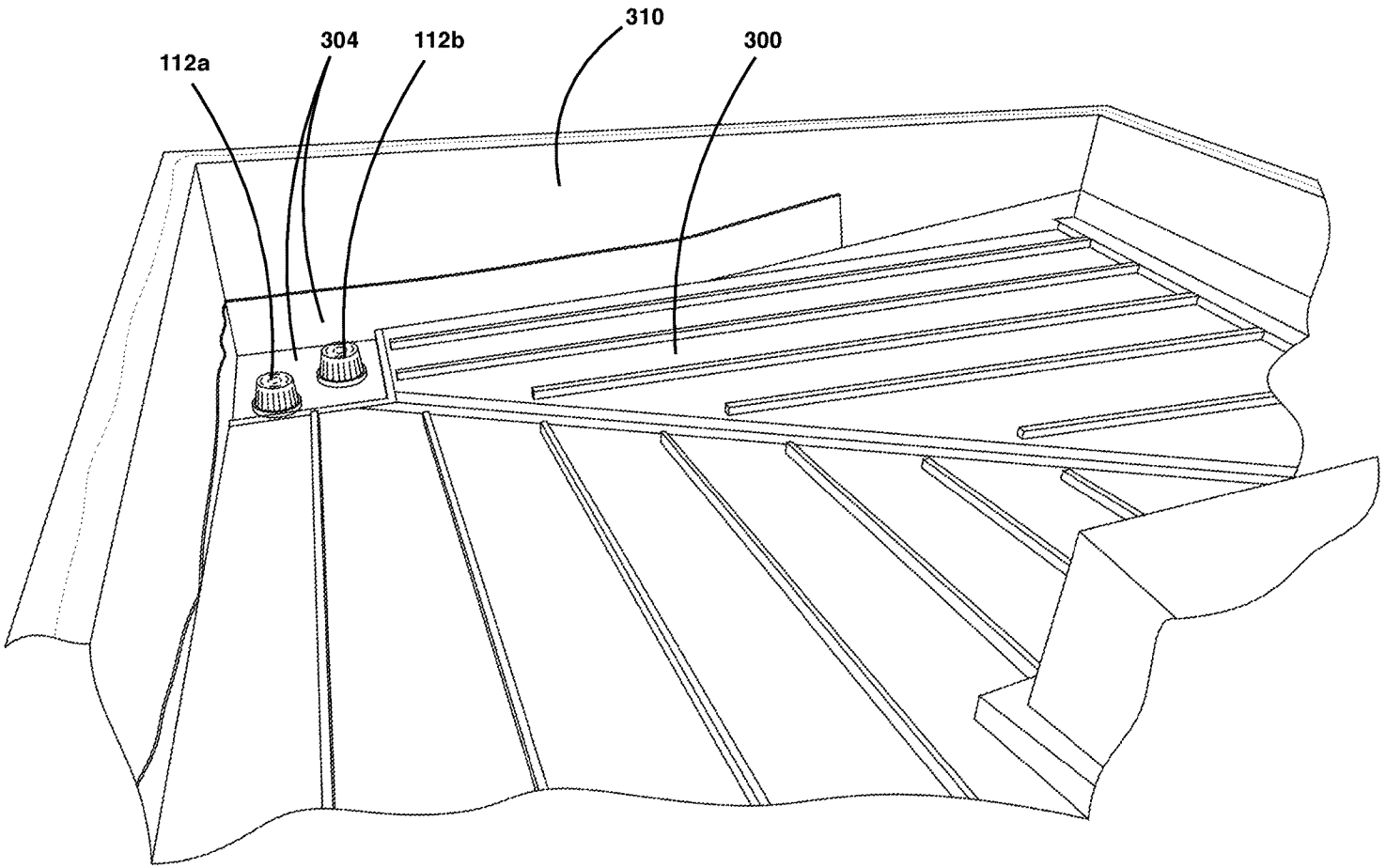
FIG. 5 illustrates a perspective partial exterior view of the rooftop rainwater drainage assembly of the disclosure described herein.

FIG. 5 further illustrates partial exterior rooftop view of the rooftop rainwater drainage assembly 100 of the disclosure described herein. Specifically, it is generally preferred for the drainage assembly and spouts 112*a* and 112*b* to be assembled and constructed near corners of the rooftop to provide the most effective way to capture rainwater flowing down roof 300. In addition, the corner area wherein spouts 112*a* and 112*b* are configured are such they are shallow, thereby essentially creating a tub having surface pitches and grading to allow for the most efficient drainage of the rainwater towards spouts 112*a* and 112*b*.

Having thus described the several embodiments of the present disclosure described herein, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention. Although the present disclosure described herein has been described in considerable detail with reference to certain preferred versions or embodiments thereof, other versions and embodiments are possible. Therefore, the spirit and scope of the appended claims should not be limited to the description of the embodiments contained herein.

What is claimed is:

1. A rooftop rainwater drainage assembly, comprising:

a first spout secured to a roof deck region of a dwelling;

a first elongated pipe having a first region disposed between an exterior wall and an interior wall of the dwelling and secured to the first spout;

the first elongated pipe having a second region that extends out of the exterior wall of the dwelling;

a second spout secured to the roof deck region of the dwelling; and a second elongated pipe having a third region disposed between the exterior wall and the interior wall of the dwelling and secured to the second spout, and the second elongated pipe having a fourth region that extends out of the exterior wall of the dwelling.

2. The rooftop rainwater drainage assembly of claim 1, further comprising a third spout or opening disposed within a parapet wall region of the dwelling.

3. The rooftop rainwater drainage assembly of claim 1, wherein the third spout further comprises one or more gates, latches, or doors.

4. The rooftop rainwater drainage assembly of claim 1, wherein the first spout further comprises a perforated drain cover.

5. The rooftop rainwater drainage assembly of claim 1, a flexible membrane cover secured to the first spout and first pipe.

6. The rooftop rainwater drainage assembly of claim 5, further comprising a bracket supporting the flexible membrane cover.

7. The rooftop rainwater drainage assembly of 6, wherein the flexible membrane cover is further secured to the roof deck region of the dwelling.

8. The rooftop rainwater drainage assembly of claim 5, wherein the flexible membrane cover is further secured to a metal standing seam roof of the dwelling.

9. The rooftop rainwater drainage assembly of claim 1, wherein the first region of the first pipe is disposed between a pair of studs of the dwelling.

10. The rooftop rainwater drainage assembly of claim 1, wherein a lower end area of the first spout is disposed within an attic space area of the dwelling.

11. A rooftop rainwater drainage system, comprising:

a first drain spout secured to a roof region of a dwelling;

a first drain pipe secured to the first drain spout, wherein the first drain pipe comprises a first section disposed between an exterior wall and an interior wall of the dwelling, thereby concealing the first section of the first drain pipe from both the interior wall and exterior wall;

the first drain pipe having a second section that extends out of the exterior wall of the dwelling;

a second drain spout secured to the roof region of the dwelling;

a second drain pipe secured to the second drain spout, wherein the second drain pipe comprises a first section disposed between the exterior wall and the interior wall of the dwelling, thereby concealing the first section of the second drain pipe from both the interior wall and exterior wall; and the second drain pipe having a second section that extends out of the exterior wall of the dwelling.

12. The rooftop rainwater drainage system of claim 11, further comprising a third drain spout secured to the roof region of the dwelling.

13. A rooftop rainwater drainage assembly, comprising:

a first spout secured to a roof deck region of a dwelling;

a first elongated pipe having a first region disposed between an exterior wall and an interior wall of the dwelling and secured to the first spout;

the first elongated pipe having a second region that extends out of the exterior wall of the dwelling;

a second spout secured to the roof deck region of the dwelling; and the second spout comprises a region that is above the first spout.

* * * * *